US006375889B1

(12) United States Patent
Holmes et al.

(10) Patent No.: US 6,375,889 B1
(45) Date of Patent: Apr. 23, 2002

(54) METHOD OF MAKING MACHINE DIRECTION STRETCHABLE NONWOVEN FABRICS HAVING A HIGH DEGREE OF RECOVERY UPON ELONGATION

(75) Inventors: Rory Holmes, Cary, NC (US); Jerry Yang, North Brunswick, NJ (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/293,269

(22) Filed: Apr. 16, 1999

Related U.S. Application Data

(60) Provisional application No. 60/082,098, filed on Apr. 17, 1998.

(51) Int. Cl.[7] ..... D04H 1/46; B29C 43/22; B29C 59/02; B29C 59/04

(52) U.S. Cl. ..... 264/518; 264/517; 264/128; 264/129; 264/282; 264/283; 156/183; 162/111; 162/112; 28/104; 28/105; 28/106; 28/169

(58) Field of Search ..... 264/282, 283, 264/128, 129, 518, 154, 517; 156/183; 162/112, 111; 28/104, 105, 106, 169

(56) References Cited

U.S. PATENT DOCUMENTS

| | | | | | |
|---|---|---|---|---|---|
| 3,255,064 | A | * | 6/1966 | Makansi | 156/166 |
| 3,485,706 | A | | 12/1969 | Evans | 428/134 |
| 3,687,754 | A | * | 8/1972 | Stumpf | 156/72 |
| 3,949,128 | A | | 4/1976 | Ostermeier | 428/152 |
| 4,421,812 | A | * | 12/1983 | Plant | 428/152 |
| 4,717,329 | A | | 1/1988 | Packard et al. | 425/328 |
| 4,735,842 | A | * | 4/1988 | Buyofsky et al. | 428/134 |
| 4,810,556 | A | * | 3/1989 | Kobayashi et al. | 428/152 |
| 4,894,196 | A | * | 1/1990 | Walton et al. | 264/282 |
| 4,919,877 | A | * | 4/1990 | Parsons et al. | 264/282 |
| 5,240,764 | A | * | 8/1993 | Haid et al. | 428/224 |
| 5,389,202 | A | * | 2/1995 | Everhart et al. | 162/103 |
| 5,428,876 | A | * | 7/1995 | Boulanger et al. | 28/104 |
| 6,068,909 | A | * | 5/2000 | Koseki et al. | 428/141 |
| 6,080,466 | A | * | 6/2000 | Yoshimura et al. | 428/152 |

FOREIGN PATENT DOCUMENTS

| | | | | | |
|---|---|---|---|---|---|
| JP | 7243159 | A | * | 9/1995 | D04H/1/48 |

* cited by examiner

*Primary Examiner*—Jan H. Silbaugh
*Assistant Examiner*—Michael I. Poe
(74) *Attorney, Agent, or Firm*—Pyle & Piontek

(57) ABSTRACT

A method of producing a non-woven fabric having a high recovery after elongation and a substantially uniform surface including the steps of microcrepeing the fabric between about 20% and 35%, and heat setting the fabric to a temperature between its glass transition temperature and its melting temperature. A non-woven fabric having a recovery of at least 40% after five cycles of 35% elongation is made from a microcreped fabric of basis weight from 1–3.5 osy. The non-woven fabric has a uniform surface that is substantially free of bunching, gathering, and that is otherwise substantially flat to the eye and touch.

13 Claims, 2 Drawing Sheets

Table 1
Elongation Recovery Comparison:

| | | | | Compaction: | | Load @ 35% Elongation (lbs) | | | Recovery % after Elongation | |
|---|---|---|---|---|---|---|---|---|---|---|
| Sample ID# | Composition: | Pattern: | Crepeing Speed: | Comp. %: | Temp. (°F) | Cycle 1 | Cycle 3 | Cycle 5 | Cycle 1 | Cycle 5 |
| 211 Control | PET 100% | 20 x 20* | 45 fpm | -- | -- | 9.24 | 5.68 | 4.38 | 28% | 15% |
| 211 DC | PET 100% | 20 x 20 | 45 fpm | 20% | 310 | 8.42 | 7.06 | 6.23 | 32% | 23% |
| 211 DD | PET 100% | 20 x 20 | 45 fpm | 35% | 310 | 1.85 | 1.66 | 1.56 | 64% | 48% |
| | | | | | | | | | | |
| 219 Control | PET 100% | Tricot** | 45 fpm | -- | -- | 7.68 | 4.68 | 3.72 | 29% | 15% |
| 219 DC | PET 100% | Tricot | 45 fpm | 20% | 310 | 5.81 | 4.72 | 4.32 | 43% | 32% |
| 219 DD | PET 100% | Tricot | 45 fpm | 35% | 310 | 1.30 | 1.20 | 1.16 | 71% | 57% |
| | | | | | | | | | | |
| 220 Control | 75/25 PET/Rayon | Tricot | 45 fpm | -- | -- | 6.72 | 3.84 | 3.04 | 28% | 15% |
| 220 DC | 75/25 PET/Rayon | Tricot | 45 fpm | 20% | 310 | 4.36 | 3.46 | 3.13 | 47% | 40% |
| 220 DD | 75/25 PET/Rayon | Tricot | 45 fpm | 35% | 310 | 1.04 | 0.95 | 0.94 | 70% | 58% |
| 220 DD ST | 75/25 PET/Rayon | Tricot | 150 fpm | 35% | 310 | 0.78 | 0.71 | 0.69 | 68% | 54% |
| | | | | | | | | | | |
| 221 Control | 50/50 PET/Rayon | (none) | 45 fpm | -- | -- | 10.18 | 4.74 | 3.44 | 24% | 9% |
| 221 DC | 50/50 PET/Rayon | (none) | 45 fpm | 20% | 310 | 5.04 | 4.15 | 3.85 | 45% | 40% |
| 221 DD | 50/50 PET/Rayon | (none) | 45 fpm | 35% | 310 | 0.80 | 0.74 | 0.72 | 72% | 57% |
| | | | | | | | | | | |
| 1301 Control | PET 100% | (none) | 45 fpm | -- | -- | 19.64 | 15.58 | 13.78 | 29% | 16% |
| 1301 DC | PET 100% | (none) | 45 fpm | 20% | 310 | 6.42 | 5.26 | 4.85 | 43% | 36% |
| 1301 DD | PET 100% | (none) | 45 fpm | 35% | 310 | 1.41 | 1.31 | 1.27 | 73% | 56% |

* 20 x 20 is fabric pattern featuring apertures
** "Tricot" is a trademark of the Polymer Group, Inc., and refers to a 3-dimensional fabric pattern having apertures

METHOD OF MAKING MACHINE DIRECTION STRETCHABLE NONWOVEN FABRICS HAVING A HIGH DEGREE OF RECOVERY UPON ELONGATION

CROSS REFERENCE

The present application claims the benefit of provisional application No. 60/082,098 filed Apr. 17, 1998.

BACKGROUND OF THE INVENTION

There is a need in the apparel industry to provide a fabric having recoverable stretch in the machine direction. The "machine direction," as used herein, is the long direction of a roll of fabric corresponding to the direction in which the fabric is conveyed on a machine as it is being produced. Some of the end uses for these recoverable stretch fabrics include waistbands, undergarment components and interlinings. It is generally known to incorporate elastic components into woven and nonwoven fabrics, but such fabrics tend either to have an uneven surface or a heavy basis weight.

Nonwoven fabrics are produced by a variety of processes in which fibers or filaments are bonded together without involving traditional textile processes such as weaving. Many of such fabrics can be elongated in the machine direction, but the elongation has very limited recovery, and the recovery disadvantageously decreases after each successive elongation.

An object of the present invention is to provide a nonwoven fabric having a low basis weight, a uniform surface, and which is capable of substantial recovery back to near original length in the machine direction upon successive elongations. A further object of the invention is to provide a method for producing the fabric of the invention.

SUMMARY OF THE INVENTION

The present invention comprises a compacted non-woven fabric with a basis weight of about 1–5 oz/yd.$^2$ ("osy") (about 31.2 gm/m$^2$ to 156.2 gm/m$^2$), having a level of recovery of at least 40% after five cycles of 35% machine direction elongation. The level of recovery is preferably greater than 50% in the machine direction after five cycles of 35% elongation. The fabric of the invention further comprises a substantially uniform surface. As used herein, the term "substantially uniform surface" refers to a surface that appears ungathered, unbunched, and otherwise substantially flat to the eye or touch.

The present invention further comprises a method for producing the fabric of the invention, generally comprising the steps of providing a non-woven polymer web with basis weight of about 1–5 osy, microcreping the web in the machine direction to a compaction of at least 20%, heat setting the web during or shortly after creping, and cooling.

Figure 1:
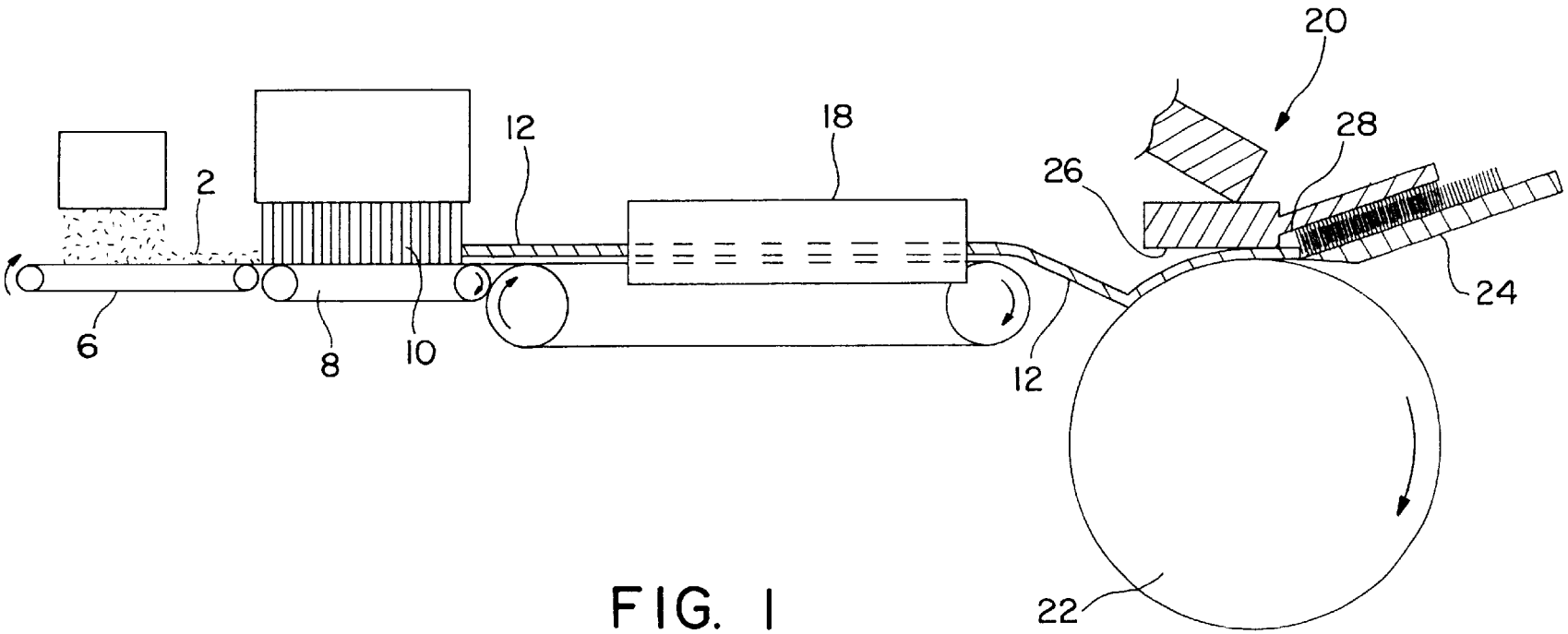
FIG. 1 shows a general schematic of a preferred embodiment of the method of the invention.

Table 1 presents comparison data between fabrics of the invention and control fabrics.

DETAILED DESCRIPTION

The present invention contemplates the use of a substrate nonwoven fabric of polymer fibers having a basis weight of about 1.0 to 5.0 ounces per square yard (osy) (31.2–156.2 gm/m$^2$), and preferably about 1.2 to 3.5 osy (about 37.5–109.2 gm/m$^2$). Preferably, the fabric comprises 50 to 100 percent polyester fibers, with the remaining fibers, if any, comprising rayon, cotton, bicomponent fibers, and the like. The most preferred fabrics contain in excess of 75% polyester fibers, such as poly(ethylene terephalate) ("PET").

FIG. 1 shows a general schematic of a preferred embodiment of the method of the invention. The nonwoven fabric is produced by a process known as hydroentanglement. In this process, a web of loose fibers 2 is produced by a series of cards or by other known equipment which is capable of producing an unbonded web of fibers, and deposited on conveyor 6. Preferred fibers are comprised of PET from 1–3.5 denier, with about 1.5 denier most preferred. Web 2 is then supported on a perforated surface 8 and is subjected to treatment with a large number of fine water jets 10, causing fiber web 2 to rearrange and become entangled into a coherent, durable nonwoven web 12. The aperture pattern in the support surface can be varied to provide a variety of apertured and non-apertured patterns. The now coherent web is transported to another conveyor 14 and passed through drier 18 for drying. The process of hydroentanglement is described in more detail in U.S. Pat. No. 3,485,706 to Evans, incorporated herein by reference.

The coherent nonwoven web 12 has a basis weight of between 1–5 osy, with 1.2–3.5 osy preferred, prior to the microcreping process that will follow. The un-compacted, pre-microcreping nonwoven web may be referred to herein as a "substrate" web or fabric.

After formation, the finished web is conveyed to microcreping apparatus 20 and is subjected to creping in the machine direction. Suitable apparatus for this operation is supplied by the Micrex Corporation. Generally, as described in U.S. Pat. No. 4,717,329 to Packard et al. incorporated herein by reference, during the microcreping process the fabric is conveyed between roll 22 and blade 24 conversing toward the roll. The nonwoven web 12 is conveyed into a conveying cavity 26, firmly gripped and conveyed into a main treatment cavity 28 where microcreping or compaction takes place. For the fabric and method of the invention, a machine direction compaction level of at least 20% is required, with about 35% preferred.

As a critical part of the method of the invention, the fabric is heated during or shortly after the creping process to a temperature that causes the crepe to retain a permanent set upon cooling. Conveniently, this may be accomplished by heating roll 22 in the creping apparatus upon which the fabric is supported. Preferably, the fabric is heated above its glass transition temperature but well below its melting temperature. In the case of the preferred polyester fabrics, the temperature should exceed 275° F., and preferably be between about 280° to 330° F. Without the heating and cooling step, the desired recovery properties upon elongation are not attained.

It is noted that FIG. 1 illustrates the preferred method of the invention as continuous. Other embodiments of the method may be carried out in steps, however. For example, the nonwoven web may be prepared separately and then subjected to crepeing.

The resulting compacted fabric of the invention comprises a substrate web of basis weight 1–5 osy that has a substantially uniform surface, and a suprisingly high level of recovery upon being stretched. Preferably, recovery of at least 40% after five cycles of 35% machine direction elongation is realized. A most preferred embodiment of the fabric of the invention has a recovery of at least 65% after a first 35% machine direction elongation and a recovery of at least 50% after the fifth 35% elongation cycle. A preferred compacted fabric of the invention farther comprises a substrate web of basis weight-between 1.2–3.5 osy.

It has been determined that application of an elastomer resin in emulsion form significantly improves the durability of the fabric in terms of subsequent handling, such as would be the case if the fabric is subjected to washing and dry cleaning. The elastomer resin is applied to the fabric with the fabric in a relaxed state. Elastomer treated fabrics also support a higher tensile load at a given elongation compared to untreated. Preferred elastomer include acrylic binders, with High Stretch V-29 available from the B. F. Goodrich Co., and ST 954, which is launderable, from the Rohm and Haas, Co. being two preferred commercial examples. The elastomer is applied from a bath at 10–12.5% solids with an add-on of 10–25%. A urethane or epichlorohydrin fixative is also preferably included with the elastomer system.

It has also been found that the use of less dense, apertured fabrics allow a higher level of compaction, up to 50%, versus the optimum 35% for more dense, unapertured fabrics. The optimum compaction value relates to optimizing the stretch and recovery features of the fabric of the invention. There is a practical limitation to the amount of compaction that can be achieved for a given fabric, based on the physical limitations of the compaction nip as well as the density of the substrate fabric. A peak percent compaction is reaches as the compaction apparatus nip has physical insertion limits beyond which more fabric may not be added. Using fabric of the basis weight of the invention, maximums have been discovered corresponding to about 35% for un-apertured fabrics, and up to 50% for apertured fabrics.

Based on test results, fabrics showing best recovery after elongation include nonapertured, hydroentangled poly (ethylene terephalate) staple fiber fabrics compacted to 35% in the machine direction and heated to 310° F., or apertured fabrics compacted at 50% and heated to 310° to heat set the microcreped fabric, followed by cooling.

EXAMPLES

Table 1 compares elongation recovery properties of several series of fabrics of the invention prepared using the method of the invention to control fabrics. The fabrics tested were compacted and exposed to temperatures as indicated in Table 1, and showed resultant elongation recovery as is likewise indicated in the table. As illustrated by Table 1, the method of the invention produces a fabric of the invention showing suprisingly high elongation recovery values, particularly for the preferred 35% creped fabrics.

Table 1 also illustrates the benefits of crepeing as shown in the "load" @ 35% elongation data. The "load" data of Table 1 refers to the resistance (tensile strength) that the fabric exhibited when elongated to 35%. As the un-creped control fabrics are elongated, individual fibers therein may break or otherwise permanently disengage from one another. This results in a significant reduction in fabric tensile strength for subsequent elongations. The creped fabric of the invention, on the other hand, does not require fibers to be broken or to disengage from one another to elongate. The fabric thus retains much more of its tensile strength after several elongations than does the control fabric.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. Method of making a nonwoven fabric which is stretchable and exhibits a high degree of recovery upon elongation in the machine direction, said method comprising the steps of:

forming a nonwoven web of loose staple polymer fibers, bonding said web by hydroentangling said web using fine water jets to form a coherent fabric without the need for a binder or fiber fusing, microcreping the fabric to compact the fabric, and heating and cooling the microcreped fabric to heat set the fabric in its microcreped state to provide a fabric having a substantially uniform surface and a recovery upon elongation of at least 40 percent after five cycles of 35 percent machine direction elongation.

2. The method of claim 1, wherein the microcreped fabric is heat set by heating to a temperature above its glass transition temperature but below its melting temperature.

3. The method of claim 1, wherein the web comprises polyester fibers.

4. The method of claim 1, wherein the web is comprised of at least 75% PET staple fibers of 1.0–3.5 denier.

5. The method of claim 1, wherein the fabric has apertures therein.

6. The method of claim 1, wherein the nonwoven fabric is compacted at least 20% during microcreping.

7. The method of claim 1, wherein the nonwoven fabric is compacted about 35% during microcreping.

8. The method of claim 1, wherein the nonwoven web has a basis weight of between about 1–5 osy.

9. The method of claim 1, wherein the nonwoven web has a basis weight of between about 1.2–3.5 osy.

10. The method of claim 1, wherein the fabric has apertures, and the fabric is compacted about 50% during microcreping.

11. The method of claim 1, further comprising the step of applying an elastic resin to the microcreped fabric.

12. The method of claim 1, wherein the elastic resin comprises an acrylic binder.

13. A method of making a nonwoven fabric having a high degree of recovery upon elongation, said method comprising the steps of:

a) hydroentangling a nonwoven web of at least 75% polyester staple fibers of 1.0–3.5 denier having a basis weight of between 1.2–3.5 osy to form a coherent fabric without the need for a binder or fiber fusing;

b) compacting the fabric about 35% by microcreping;

c) heat setting the microcreped fabric at about 310° F.; and d) applying an acrylic binder to said microcreped fabric to form the nonwoven fabric wherein the nonwoven fabric has a substantially uniform surface and a recovery upon elongation of at least 40 percent after five cycles of 35 percent machine direction elongation.

* * * * *